US006828943B2

(12) United States Patent
Deguchi

(10) Patent No.: US 6,828,943 B2
(45) Date of Patent: Dec. 7, 2004

(54) RADIATING METHOD AND RADIATING APPARATUS OF WAVE MOTION FOR GIVING REDUCING PROPERTIES

(75) Inventor: Katsuhiko Deguchi, Nissei Haitsu 303, 2-1-45, Matsuzakicho, Abeno-ku, Osaka-shi, Osaka-fu (JP)

(73) Assignees: Sotaro Mizusawa, Kanagawa-ken (JP); Katsuhiko Deguchi, Osaka-fu (JP); Megumi Matsumoto, Ken (JP)

( * ) Notice: Subject to any disclaimer, the term of this patent is extended or adjusted under 35 U.S.C. 154(b) by 0 days.

(21) Appl. No.: 10/395,515

(22) Filed: Mar. 24, 2003

(65) Prior Publication Data

US 2004/0041738 A1 Mar. 4, 2004

(30) Foreign Application Priority Data

Sep. 2, 2002 (JP) ..... 2002-256570

(51) Int. Cl.[7] ..... H01Q 9/04; H01B 17/58

(52) U.S. Cl. ..... 343/791; 174/34

(58) Field of Search ..... 343/790, 791, 343/792; 174/33, 34, 35 C

(56) References Cited

U.S. PATENT DOCUMENTS 4,601,530 A * 7/1986 Coldren et al. ..... 439/460
4,766,291 A * 8/1988 Collins ..... 219/534
4,937,588 A * 6/1990 Austin ..... 343/791
5,600,338 A * 2/1997 Ecklund et al. ..... 343/790
6,057,804 A * 5/2000 Kaegebein ..... 343/792

* cited by examiner

*Primary Examiner*—Don Wong
*Assistant Examiner*—Minh Dieu A
(74) *Attorney, Agent, or Firm*—Fattibene and Fattibene; Paul A. Fattibene; Arthur T. Fattibene

(57) ABSTRACT

A conventional method for giving reducing properties uses medication or medium and thus, a range in which the method can be utilized is limited, and there is apprehension that the method adversely affects the environment of ecological system. Further, an apparatus for giving reducing properties is large in scale, and there is an adverse possibility that the apparatus adversely affects other electronic equipment. It is an object of the present invention to solve these problems. A plurality of coaxial cables are arranged as radiators 3 in a form of comb teeth-like shape. Each of the coaxial cable has a predetermined length and a dielectric 3*c* between an internal conductor 3*a* and an external conductor 3*b*. The coaxial cables are connected to an oscillator in series for supplying high frequency alternating current. A capacitor 5 is interposed between the internal and external conductors 3*a* and 3*b* of each the radiator 3, currents are allowed to flow through the internal conductor 3*a* and the external conductor 3*b* in the opposite directions, thereby radiating a subject with wave motion which generates reducing properties by an electron giving effect.

17 Claims, 5 Drawing Sheets

RADIATING METHOD AND RADIATING APPARATUS OF WAVE MOTION FOR GIVING REDUCING PROPERTIES

BACKGROUND OF THE INVENTION

1. Field of the Invention

The present invention relates to a method for giving high reducing properties (properties for supplying electron or hydrogen) to a predetermined indoor and outdoor space region and a subject such as flora and fauna existing in such a region, and the invention also relates to an apparatus used therefor.

2. Description of the Prior Art

Conventionally, as a method for giving reducing properties, a chemical method using electron giving medication or reducing medication is known. In this method, however, water or liquid is generally used as medium, and reducing properties can not immediately be given to the space region or the subject through the space region without using the medium.

Even if an electrochemical method is used, since reaction in an interface of an electrode is utilized, existence of electrolyte is indispensable, and the reducing properties can not immediately be given to the subject like the above method.

As an apparatus for increasing negative potential which enhances the reducing ability without using medium, there exists a minus ion generating apparatus. This minus ion generating apparatus discharges minus ion into the air utilizing spark discharge in the air by high voltage.

In addition to the above, there are totally new method and apparatus shown in Japanese Patent Application No.2001-59483 previously filed by the present assignee.

The above-described conventional reducing method using a medium is for a specific field such as cleaning or working of article, and can not be used depending upon a subject such as flora and fauna, drink and food. The conventional radiating method can not be utilized for improving an environment such as life space.

Further, the minus ion generating apparatus in which electric discharge is carried out in the air between electrodes and generated minus ion is discharged does not use a medium and thus, such minus ion generating apparatus can directly change an environment such as life space and can directly give the minus ion effect to a subject located in such a space. However, there is a problem that the minus ion generating apparatus generates unnecessary plus ion together with minus ion generated by electric discharge, and if people breathes a large amount of plus ion, ozone which is harmful for human is generated. There is also a problem that a region where the minus ion effect is exhibited is limited because the electric discharge is carried out in the air. Further, the minus ion generating apparatus requires electrodes, a high voltage power source and the like, the apparatus is increased in size and cost, and since noise is generated when the apparatus is operated, the apparatus give annoyance to a user, and adversely affects a transmitter-receive or a precision machine near the apparatus.

Japanese Patent Application No.2001-59483 filled by the present assignee has a problem that technical contents disclosed therein do not reach sufficient principle understanding, it is not always possible to obtain complete reproducibility, and it is difficult to realize scale up.

SUMMARY OF THE INVENTION

It is an object of the present invention to solve the problems of the above-described conventional radiating method and reducing apparatus.

To achieve the above object, a first aspect of the present invention provides a radiating method of wave motion for giving reducing properties using a plurality of coaxial radiators, wherein each of the coaxial radiators is provided at its center with an internal conductor, and an external conductor provided around the internal conductor through a dielectric, the coaxial radiators are arranged in a form of comb teeth-like shape, alternating current of high frequency corresponding to resonance frequency of the coaxial radiator is applied to the internal conductor and the external conductor such that directions of currents flowing through the internal conductor and external conductor are opposite, thereby oscillating ultrasound and generating variable electric field called static radio wave, and giving the reducing properties to a subject by an electron giving effect.

In the first aspect, there is provided the coaxial radiators arranged in the form of comb teeth-like shape and each of which is provided at its center with the internal conductor, and the external conductor provided around the internal conductor through the dielectric, and the alternating current of high frequency corresponding to resonance frequency of the coaxial radiator is applied to the coaxial radiator, thereby generating wave motion having electron giving effect. Therefore, there is effect that it is possible to easily give reducing properties to a subject existing around the coaxial radiator.

A second aspect of the invention provides a radiating apparatus for giving reducing properties comprising a plurality of coaxial radiators arranged in a form of comb teeth-like shape and each of which is provided at its center with an internal conductor, and an external conductor provided around the internal conductor through a dielectric, and an oscillator for supplying high frequency alternating current to the coaxial radiator, wherein alternating current of high frequency corresponding to resonance frequency of the coaxial radiator is applied to the internal conductor and the external conductor such that directions of currents flowing through the internal conductor and external conductor are opposite, thereby oscillating ultrasound and generating variable electric field called static radio wave, and giving the reducing properties to a subject by an electron giving effect.

In the second aspect, the radiating apparatus comprises the coaxial radiators arranged in the form of comb teeth-like shape and each of which is provided with the internal conductor and the external conductor with the dielectric interposed therebetween, and an oscillator for supplying high frequency alternating current to the coaxial radiator. Therefore, there is effect that although the radiating apparatus can be easily produced inexpensively, reducing function by the electron giving effect can be obtained.

According to a third aspect of the invention, in the structure of the second aspect, each of the coaxial radiators is connected to the oscillator in series, a capacitor is provided between the internal conductor and the external conductor for turning wavelength to the applied alternating current wavelength.

In the third aspect, each of the coaxial radiators is connected to the oscillator in series, a capacitor is provided between the internal conductor and the external conductor for turning wavelength to the applied alternating current wavelength. Therefore, there is effect that desired wave motion can be generated irrespective of a length of the coaxial radiator.

According to a fourth aspect of the invention, in the structure of the second or third aspect, the coaxial radiators are curved in the same direction with equal curvature by fixing the coaxial radiators onto a curved reflection plate.

In the fourth aspect, the coaxial radiators are curved in the same direction with equal curvature. Therefore, there is effect that it is possible to strongly emit the generated wave motion in a predetermined direction.

According to a fifth aspect of the invention, in the structure of any one of the second to fourth aspects, the coaxial radiator comprises a coaxial cable which is cut to a predetermined length.

In the fifth aspect, the coaxial radiator is formed of the coaxial cable. Therefore, there is effect that this kind of radiating apparatus of wave motion for giving the reducing properties can be easily produced inexpensively.

According to a sixth aspect of the invention, in the structure of the fifth aspect, a casing of the coaxial cable is removed.

In the sixth aspect, in addition to the effect of the fifth aspect, there is effect that it is possible to radiate the generated wave motion more strongly without attenuating the wave motion with this casing.

DESCRIPTION OF THE PREFERRED EMBODIMENT

Figure 1:
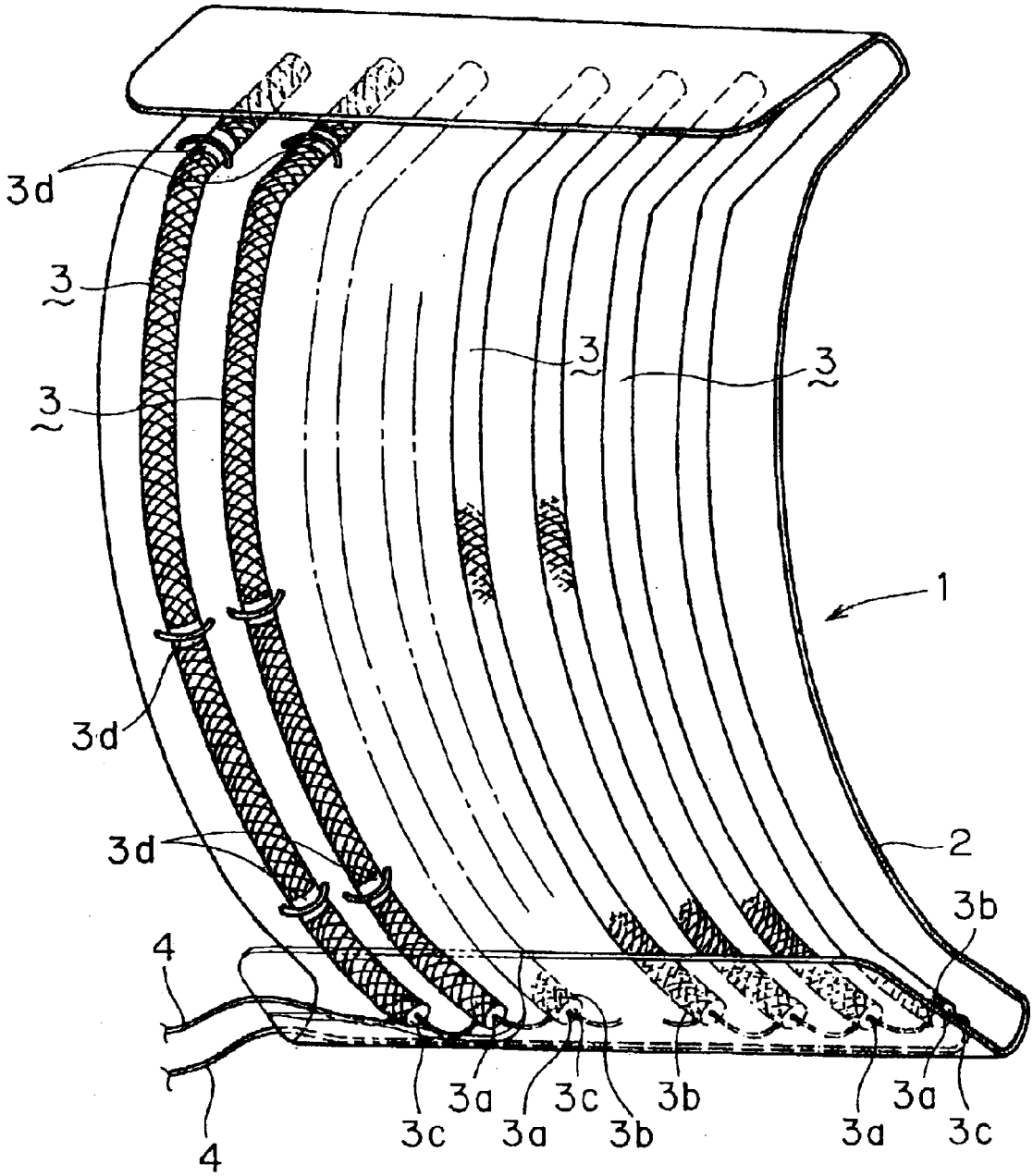
FIG. 1 is a perspective view of an embodiment of a radiating apparatus of wave motion for giving reducing properties according to the present invention.

First, a process leading to the present invention will explained. In order to give reducing properties to an object, it is necessary to give properties which supply electron or hydrogen to the object. At that time, in order to directly give electron to the subject without using a medium, the inventor considered that electromagnetic wave having such function should be radiated. However, general electromagnetic wave is transverse wave in which displacement is perpendicular to a moving direction of the wave, i.e., the general electromagnetic wave is wave which is inverted at half wave dimension. Therefore, even if electromagnetic induction electrification is generated in a subject, the electromagnetic induction electrification is balanced, and negative electrical charge can not be remained.

Thereupon, the inventor considered that unlike the electromagnetic wave, if wave motion called vertical wave, standing wave or static radio wave is emitted, negative electric charge and reducing properties could be given to a subject, and studied hard and repeatedly carried out experiments.

First, in order to obtain the required wave motion, it is necessary to bring the transverse wave component emitted from the radiator to zero, or to reduce the transverse wave component as low as possible. To that end, electric field generated in the radiator by a passing current should be reduced to zero or a lower value. Thereupon, the present inventor considered that the skin effect in the coaxial cable was reversely utilized, that is, a phenomenon that in the coaxial cable, current is prone to pass through an outer peripheral portion of the coaxial cable as compared with its core portion and high frequency current or electromagnetic wave is confined to a surface area of the conductor and does not enter the inside of the conductor was reversely utilized, and if the coaxial cable is used in a manner similar to a monopole or dipole antenna, generated electric field and magnetic field could be brought into non-balanced state, and if the coaxial cable was disposed in a comb teeth-like manner like a meander line which generates surface acoustic wave, a desired wave motion could be generated.

Thus, using a coaxial cable having a predetermined length, high frequency alternating current corresponding to the resonance frequency of the coaxial cable was applied between a internal conductor which is a center conductor of the coaxial cable and a surrounding external conductor such that directions of the current flowing therethrough became opposite directions and as a result, substantially expected effect could be obtained.

The following measuring devices were used in the experiments.

"electromagnetic wave meter" (Corporation) Mother Tool, EMF-825

"Midair ultrasound sensor" Nippon Ceramic #R40-16

"ORP meter" Toua Radio Wave (Body), "ORP meter RADIATING METHOD-20P", No.A8CLO93W (Sensor), "PST-2739C", No.010F0009

"Ion counter", Kyouritsu Electronics, KEC-800 type

Whether the reducing properties were generated was checked by using tap water as water-detecting body and measuring its ORP (Oxidation-Reducation Potentials) value.

Here, the ORP value will be explained briefly. Generally, concerning ability of one substance for oxidizing or reducing the other substance, the oxidizing ability (ability for receiving electron or hydrogen) is higher as positive potential is greater, and the reducing ability (ability for supplying electron or hydrogen) is higher as negative potential is greater. Therefore, it is possible to easily know the ability of one substance for oxidizing or reducing the other substance by measuring oxidation-reduction potential thereof. The ORP value is the oxidation-reduction potential, and is widely used as an index for measuring the oxidation-reduction ability of a compound.

In order to corroborate the phenomenon obtained by this experiment, the consideration will be described from various view points.

First, between the internal conductor and the external conductor of the coaxial cable used as a radiator, current (reciprocating current and current in the opposite direction) in accordance with a capacitance of dielectric existing between the internal conductor and the external conductor flows, the coaxial cable functions as an antenna, and emits radio wave. In recent years, it was found that a clone force was applied between the internal conductor and the external conductor at that time, and both the conductors were vibrating slightly at two times frequency of the applied alternating current frequency.

Further, if an operating method for using a space extremely close to the radiator as an effective region (it is known that wave which does not carry energy exists only in a location which is extremely close to a wave source (=standing wave)) is employed, it can be handled as standing wave.

A composition of electromagnetic field component formed by the radiator has a small number of magnetic field components and thus, the composition becomes longitudinal wave whose electric field component is extremely strong in a direction of a coaxial center line. It is known that the longitudinal wave becomes extremely strong field in a range of 1 wavelength radius in the vicinity of the wave source. It is also known that the longitudinal wave generates electrostatic induction with respect to a subject, and electric field enters in accordance with dielectric constant of the substance.

Electron particle properties are widely known. In "electron existence probability wave" theory in which wave motion is discussed, it is said that depending upon the existence condition (existence state) of electron, there are three cases, i.e., a case in which the particle properties become clear wave-like shape, a case in which it seems that the particle properties spread over the entire space, and the particle properties become wave packet and behave like particles.

The reason thereof is that phases of $\phi R$ and $\phi I$ of "$\phi R^2+\phi I^2$" which shows existence probability are different through 90°.

In the coaxial radiator, if terminals of the internal conductor and the external conductor are connected to each other and voltage is applied thereto in the same manner as that described above, the reciprocating current flows of course, but radiation from the center internal conductor and radiation from the surrounding external conductor are deviated in the opposite directions through 180°, but the radiation from the internal conductor is deviated into the electric field (generated in proportion to voltage) and the magnetic field (generated in proportion to current) through about 90° depending upon existence of dielectric between the conductors (assumed from common sense that the current and voltage generate a phase difference of 90° due to existence of dielectric). It is considered that it becomes composite space radiation wave having phase deviation of 90° obtained by adding (or subtracting) this 90° from the above 180°. In the case of general electromagnetic wave emitted from a monopole or dipole, it is considered that this radiation wave having nuance which is different from a fact that phases of the electric field and the magnetic field are not deviated in the transverse wave has properties which are in tough with "electron existence probability wave" (=electron wave).

It is known that if wavelength (frequency) of radiation wave is different, phenomenon (properties thereof) is also different, but it can be understood that even if the wavelength is the same, if the waveform is different, a difference is generated in phenomenon. That is, radiation wave generates complicated interference in a space depending upon various conditions such as whether the coaxial radiator is disposed straightly or is curved, whether a single coaxial radiator is used, a plurality of coaxial radiators are used, how the coaxial radiators should be arranged when the plurality of coaxial radiators are used, terminals of the coaxial radiators should be opened at that time, whether the terminals should be connected, whether the coaxial radiators should be connected in series or parallel for excitation. In the experiment, these conditions were variously combined and verified, and effective layout and combination of radiators were selected from various phenomena obtained as a result.

From view point of adjustment of properties of radiation wave (appearing phenomenon) and a width radiation amount, it is considered that an aggregation type in which a plurality of straight or slightly curved radiators are arranged on a flat surface or slightly curved surface is a good idea, and this point was verified in the experiment.

In a radiator which is wound into a coil-like manner, extremely strong longitudinal wave is generated in the center axis of the coil, but it is extremely difficult to adjust and form the radiator and thus, this radiator was removed from this experiment.

When radiators are gathered, it is a common sense that a length of each radiator has correlation to frequency. That is, when the length is "number times of 1/wavelength", resonance and syntony are caused, and radiation is completely generated. The length also has correlation to capacitance of dielectric existing between the internal conductor and the external conductor.

The number of radiators to be arrange has correlation to the width radiation amount, but an interval between the radiators largely influence the interference. The connection and opening of the terminal will determine the basic properties of the radiation wave, and it is considered that if one of the connection and the opening is taken and mixed, the radiation wave is further complicated.

In order to arrange the plurality of radiators in lines and make the entire into a flat surface of a curved surface, it is possible to mount the radiators to a reflection plate type metal plate and assemble them. In this case, if the metal plate is used as a reflection plate, there is an adverse possibility that absorption (static induction-electric field invasion-secondary radiation (refection)) and dissipation of radiation energy are generated. The metal plate is not preferable because it causes electromagnetic induction. It is preferable that aluminum, copper or ceramic having no magnetic properties is used.

The coaxial radiator is not always limited to the above-described coaxial cable only if the coaxial radiator is a cylindrical member provided at its center with an internal conductor and its surrounding with an external conductor through a dielectric (it may be an air layer). If there is nothing corresponding to a casing of the coaxial cable, it is preferable because higher radiation effect can be obtained.

Next, a radiating apparatus according to the present invention obtained as a result of the experiment will be explained in detail based on an illustrated embodiment.

FIG. 1 is a perspective view of a radiating apparatus 1 of wave motion giving reducing properties according to the present invention. As shown in FIG. 1, the radiating apparatus 1 comprises an aluminum reflection plate 2. A surface of the reflection plate 2 is curved such that the surface projects outward (left frontward on a sheet of FIG. 1), and opposite ends of the reflection plate 2 are folded back. A plurality of thin and long coaxial radiators 3 are arrange at predetermined distances from one another in a vertical direction in line. Each of the coaxial radiators 3 is provided at its center with an internal conductor 3*a*, and its surrounding is covered with an external conductor 3*b* through a dielectric 3*c* which is an insulative material. Here, a coaxial cable for TV antenna wire (3C to 2V) having the same structure is appropriately used. The casing 3*d* covering an outer surface of the coaxial cable is removed except a connecting portion to the reflection plate.

Figure 2:
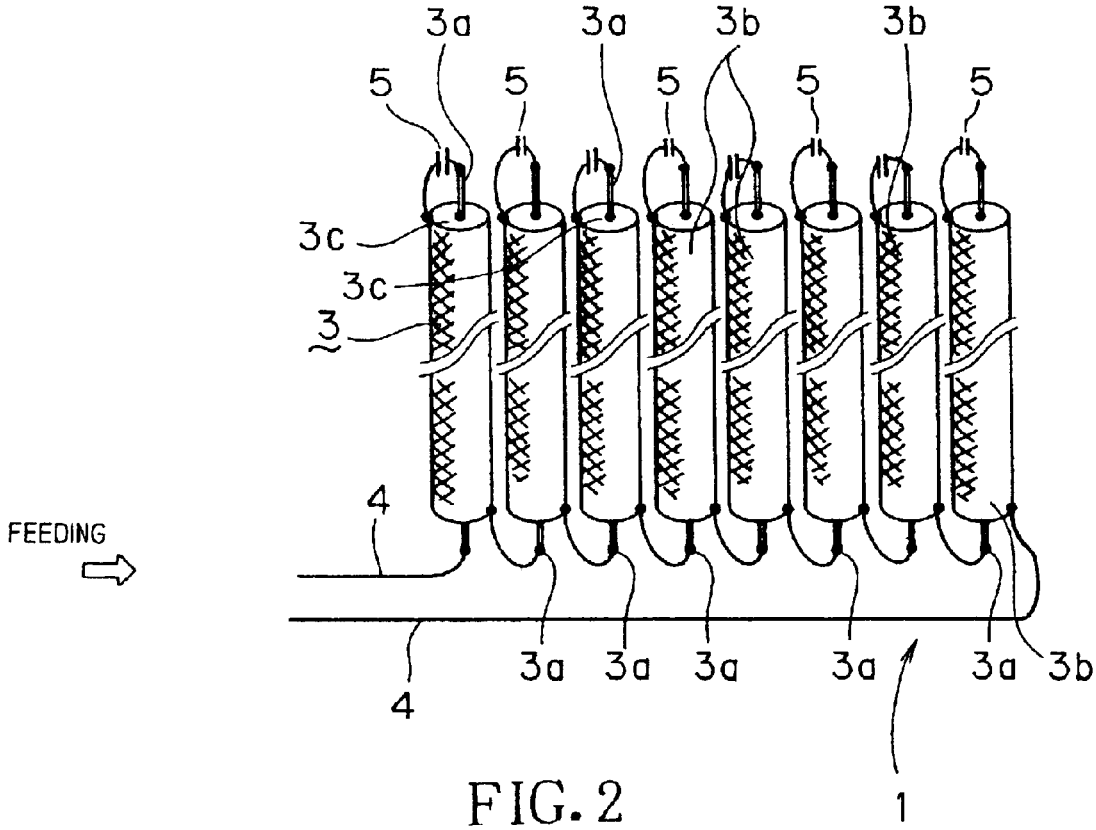
FIG. 2 is a schematic explanatory view of a wire connecting portion of the apparatus shown in FIG. 1.

The radiators 3 made of coaxial cable have length of about 30 to 50 cm. The internal conductors 3*a* and the external conductors 3*b* of the series, i.e., adjacent coaxial radiators 3 in one ends (lower ends in FIG. 1) are alternately connected to each other. Leads 4 pulled out from the opposite ends are connected to a power source through an oscillator (not shown) which converts supply power source into predetermined frequency. As shown in FIG. 2, in the other ends (upper ends) of the coaxial radiators 3, the internal conductors 3*a* and the external conductors 3*b* are connected to each other through capacitors 5. The capacitor 5 is used for turning the radiator to a wavelength of the alternating current frequency supplied to the radiating apparatus 1. That is, by providing the capacitor 5, the same effect as a case in which a single body length of a single radiator 3 is elongated is obtained. If calculation is carried out based on the assumption that the capacitance in each radiator 3 is 67 pF/m, if a capacitor of 2.2 $\mu$F is connected, the single body length corresponds to 32,836 m.

Here, in the present invention, an oscillator which outputs alternating current of frequency of 2.5 KHz at input DC12V, 10 mA was used. In this case, since wavelength $\lambda$ of radio wave of this frequency is 120 km, a length of the radiator which produces resonance thereto is ¼ n (n=multiple). Therefore, a length of the radiator to which the capacitor of 2.2 $\mu$F is connected corresponds to about ¼ of the wavelength, which substantially satisfies the condition for producing resonance. A capacitor which is connected in this manner and which corresponds to ¼ n of wavelength of the applied alternating current frequency may appropriately be selected and used.

The radiating apparatus 1 of wave motion of the present invention having the above structure was placed on a predetermined indoor position in its excited state, changes with time of ORP values of water-detecting bodies placed around the radiating apparatus 1 were measured and its effect was confirmed.

The test was carried out in one section (about 35 square meters) on a third floor of a general high-rise apartment (steel-framed concrete five-story building) in Osaka-shi. In the room, general furniture was placed, and the radiators were placed on an upper portion of a wall surface and on the furniture. The "water-detecting bodies" were placed on a plurality of positions, i.e., on another furniture in the same room and in the furniture.

A straight distance from the radiating apparatus 1 to the water-detecting body was 0.45 to 5.5 m, the furniture and a utensil exist on the straight line and they become impediments and thus both of them could not be seen directly.

General tap water was used as the water-detecting body, and two kinds of containers, i.e., a general glass cup having volume of 180 ml, and a PET bottle (PET, hereinafter) formed into a container were used. A volume of water to be charged was 150 ml in each container.

The water-detecting bodies were placed on positions in the room away from the radiating apparatus 1 by 0.45 m, 1.2 m, 3.0 m, 4.2 m and 5.5 m, respectively, and changes with time of ORP values were measured.

At the time of measurement, it is necessary to add potential of silver chloride electrode with respect to hydrogen electrode in the strict sense, but a numeric value indicated on an ORP meter is used as it is to prevent the procedure from being complicated.

The following Table 1 shows the changes with time of ORP values of the water-detecting bodies measured in this manner.

TABLE 1

| | | | A distance (m) from the radiating apparatus | | | | | | | | | |
|---|---|---|---|---|---|---|---|---|---|---|---|---|
| | | | 0.45 | | 1.2 | | 3.0 | | 4.2 | | 5.5 | |
| | | | Water-detecting body | | | | | | | | | |
| Date | | Operation | A | | B | | C | | D | | E | |
| 1/19 | 12. 00 | Excitation | 721 | — | 721 | — | 721 | — | 721 | — | 721 | — |
| | 13. 00 | | 142 | 145 | 222 | 228 | 143 | 147 | 233 | 239 | 271 | 282 |
| | 16. 30 | | −18 | −21 | 55 | 54 | 43 | 35 | 96 | 97 | ↓ | |
| | 22. 00 | | −42 | −38 | 61 | 61 | 25 | 27 | ↓ | | ↓ | |
| 1/20 | 10. 00 | | −43 | −48 | −83 | −82 | −29 | −20 | −88 | −103 | 54 | 55 |
| | 16. 30 | ↓Cut | ↓ | | 128 | 106 | 73 | 81 | 89 | 87 | ↓ | |
| 1/21 | 10. 30 | excitation | 183 | 103 | 233 | 220 | 193 | 161 | 184 | 174 | 233 | 234 |
| | 20. 00 | | 223 | 183 | ↓ | | ↓ | | 192 | 138 | 201 | 156 |
| 1/22 | 10. 00 | | 171 | 122 | 193 | 114 | 176 | 178 | 181 | 136 | 205 | 198 |

(ORP value. unit is mV)

As apparent from this Table, an ORP value of the water-detecting body placed together with the radiating apparatus 1 was at first 721 mv, but this value was reduced abruptly with time. This change was greater as approaching the radiating apparatus 1, and apparent correlation was confirmed.

At that time, a PH value of the water-detecting body was also measured at the same time, but the value was not changed almost at all from the original 7.3. Change in an ORP value of tap water at a position (another room away from the radiator by 20 m or longer) where influence of the radiator was not exerted was also measured for comparison, but significant change could not be found in one day, and even of the water-detecting bodies were left as they were for 10 days, the value was only reduced to about 300 mV.

After the ORP value of the water-detecting body was sufficiently reduced, the radiation was discontinued and the subject water (subject water-detecting body) was left as it was in the same room, the deterioration of the ORP value was gradually proceeded and after about 24 hours, the value became about 30 mV. On the other hand, a small number of the subjects were placed in a normal space (the same building, and in a tool repository), but the deterioration was gently proceeded, and after several days, the value became 120 to 200 mV.

Further, new tap water (about 700 mV) was placed as the same water-detecting body in the room where the radiation was discontinued, the value became 130 to 200 mV after 24 hours, and this value did not change almost at all even if about 80 hours were elapsed.

From the above facts, it can be found that almost all region in the room is reduced, and a remainder reduces a new substance (which is inferior in reducing properties).

When the apparatus of the present invention was operated, it was confirmed by the ion counter that the amount of surrounding minus ions was increased. It is considered that influence of ultrasound which is supervened from the apparatus of the invention and influence by the static radio wave synergistically exhibit the effect.

At the time of the experiment, all frequencies of AM and FM were received using a portable radio, but noise derive from radiation wave could not be recognized. No harmful influence could not be recognized in a TV, a cellular phone, a personal computer and the like used in the room.

When the radiating apparatus 1 is used in a space region, the radiating apparatus 1 may be accommodated in a plastic case, or the above-described style may be employed. The radiating apparatus 1 accommodated in the plastic case may be formed into a watertight structure, and it may be sunk in water, or may float on water or may be embedded under the ground for use. Even a naked radiating apparatus 1 without case may also be sunk in water or embedded under the ground for used if each the coaxial radiator 3 is covered with the insulative casing 3*d*.

Table 2 shows a result of an experiment in which the radiating apparatus 1 was sunk in water and excited, and ORP values of water-detecting bodies placed in predetermined positions were measured in the same manner as that described above.

TABLE 2

| | | A distance (m) from the radiating apparatus | | | | | | | | | |
|---|---|---|---|---|---|---|---|---|---|---|---|
| | | 0.45 | | 1.2 | | 3.0 | | 4.2 | | 5.5 | |
| | | Water-detecting body | | | | | | | | | |
| Date | Operation | A | | B | | C | | D | | E | |
| 2/12 21.00 | Tap Water | 702 | — | 702 | — | 702 | — | 702 | — | 702 | — |
| 2/13 9.00 | | 77 | 65 | 23 | 16 | 60 | 51 | 47 | 49 | 82 | 86 |

(ORP value. unit is mV)

As apparent from this Table, in this case also, the ORP values of the water-detecting bodies are abruptly reduced with time which can not be happened under natural environment. A change in the ORP value of a water-detecting body A placed on a position closest from the radiator 1 was smaller than those of water-detecting bodies B and C placed on positions further from the radiator 1, but in the water-detecting bodies B and C, the change in the ORP value is greater as the water-detecting body is closer, and clear correlation could be recognized therebetween.

Examples of findings obtained during the experiment are elongation of freshness of vegetables, elongation of aging period of cut flowers, facilitation of growth of potted plants, facilitation of vaporization and dissipation of liquid, improvement of taste of bottled, canned or packed beverage and foods, change in oxidizer water solution, dechlorination of tap water and the like.

Since ultrasound is supervened from the apparatus of the invention, it is possible to facilitate vaporization and dissipation of included moisture without adding heat to the subject. Therefore, it is possible to dry vegetables without deteriorating nutrition included in foods such as the vegetables. Further, it is possible to facilitate vaporization of formalin and various volatility organic compound included in construction materials in a house, and such formalin and compounds can be rendered harmless by the reducing effect, and it was confirmed that this was also effective for sick house countermeasures.

From the above facts, the following points were found. That is,

1) By connecting the internal conductor and the external conductor of the coaxial radiator to each other, radiation having deviated phase can be obtained.
2) In the case of an aggregation type radiating apparatus in which a plurality of coaxial radiators are arranged, the interference of radiation waves becomes complicated in accordance with the number of radiators, but width radiation amount (intensity and radiation range) is increased.
3) It is preferable to connect a power supply lead in series.
4) A curved coaxial radiator is more preferable that straightly stretched coaxial radiator.
5) It is preferable that a reflection plate exists.
6) It is preferable to connect the internal conductor and the external conductor of each coaxial radiator through a capacitor.
7) It is preferable to use alternating current power source of high frequency (100 Hz to several 10 Khz).

In view of various points of change and influence (effect) generated in a substance or material (by radiation) or which received radiation, the following features of the present radiation wave can be listed.

(1) It can not be considered that properties of general (transverse wave used for communication, i.e., electromagnetic wave in which electric field component and magnetic field component coincide with each other) radio wave is the same.

It is considered that this is because that noise can not be recognized by AM and FM reception, this is natural because frequency of supply of power is 2.5 KHz, but since the magnetic field components of the radiation wave only have extremely small number electric field components, this is not carrier wave (electromagnetic wave of transverse wave) which carries noise which is not complete transverse wave and thus, it can be handled as "standing wave".

(2) Compared with energy of infrared rays (one kind of electromagnetic wave) which gives physical effect, if a substance or material is radiated with (absorbs) infrared rays, scientific reaction is not generated almost at all, and most of its energy is converted into thermal energy. In an electric heater utilizing this principle, an ORP value of a water-detecting body which received radiation (heat) was gradually enhanced up to a certain degree but to a far lesser extent than in the present invention apparatus. Further, it is considered that a power source of the present invention apparatus is an IC circuit having input of 10 mA at DC12V and output of 2.5 KHz and thus, the average radiation output is several mW or less, and from this, it can be found that energies of both of them are totally different in quality.

(3) Dissipation and evaporation of moisture and liquid in the subject were facilitated, and oscillation of ultrasound was recognized by an ultrasound sensor.

(4) This radiation wave has feature that permeability is excellent and frequency is low and thus, attenuation is low.

(5) If improvement of an ORP value of the "water-detecting body" is regarded as increase of hydrated electron, it is considered that the electron is ascribable to the fact that the radiation wave is absorbed by the a detecting body container (glass, PET or the like), electric charge is generated and electric charge is generated in filled water by "induction electrification" principle. Further, electrostatic charge of deep immersion degree (excessive electron, reducing properties) is given not only to water of the water-detecting body but also to empty container, furniture, wall, tatami and cloths, and this is remained for relatively long time and thus, it has properties of static radio wave.

From the above facts, it is considered that this radiation wave is called variable electric field, i.e., static radio wave which does not belong to electromagnetic wave or radio wave, and at the time of radiation thereof, surface acoustic wave generated by high frequency passing current is also generated.

Theoretical corroboration of this point is as follows:

(1) It is known that if high frequency alternating current is allowed to pass through a comb teeth-like electrode, surface acoustic wave (SAW) which is one kind of ultrasound is generated as transducer. In the radiating apparatus of the present invention, excitation current passes through a outer braiding portion of the coaxial cable which is radiating element, and passes through the inner core portion (although the direction is opposite). A style in which a plurality of coaxial cables is provided is similar to the comb teeth-like electrode.

From the above point, it is considered that ultrasound emitted from the radiating apparatus of the present invention has properties of the surface acoustic wave.

(2) According to "meander line" theory, a meander line can transfer low frequency electromagnetic wave including direct current, and frequency at which a length of the conductor becomes equal to ¼ of wavelength is regarded as center frequency of excitation band region. In the radiating apparatus of the present invention, the capacitor is interposed between the internal conductor and external conductor of the coaxial radiator, and a phantom length of the radiator is set to ¼ of wavelength (30 km) of the applied current frequency (2.5 KHz).

Therefore, ultrasound emitted from the radiating apparatus of the present invention is multiple frequency having frequency of about 20 KHz as its center. This will be described next.

Figure 3:
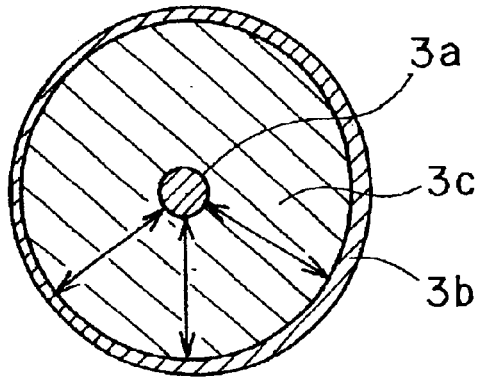
FIG. 3 is an explanatory sectional view showing a force applied to a coaxial radiator.
Figure 4:
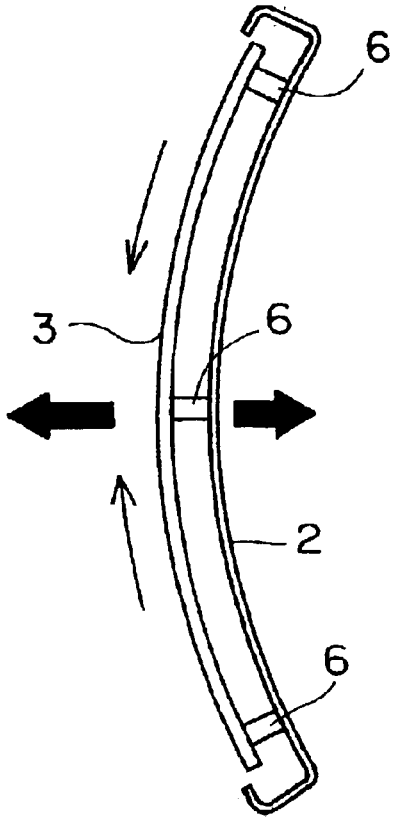
FIG. 4 is a side view showing a direction of a force applied to a reflection plate.

(3) A clone force is applied between charged two conductors. In the case of alternating current, these conductors slightly oscillate with two times frequency of alternating current frequency. In the coaxial radiator of the present invention, a direction of current flowing through the core internal conductor and a direction of current flowing through the braiding external conductor are always opposite and thus, repulsion force is periodically generated in directions shown with arrows in FIG. 3. Therefore, the coaxial cable as a radiating element repeats swinging expansion in the radial direction, but since the coaxial radiator is fixed to the reflection plate through the insulative spacer as shown in FIG. 4, this force acts as tensile force in the longitudinal direction of the coaxial radiator. Thus, this oscillation oscillates the reflection plate which is mounted as a result in the longitudinal direction (direction shown with thick arrows in FIG. 4), and this oscillation is propagated to air.

As described above, in the radiating method of wave motion which gives reducing properties, high frequency alternating current corresponding to resonance frequency of the coaxial radiator is allowed to flow between the internal conductor and the external conductor of each of the plurality of coaxial radiators disposed in a form of comb teeth-like shape, thereby generating surface acoustic wave and static radio wave which give the reducing properties to the subject.

Next, a preferred example of the radiating apparatus produced based on this theory will be described.

[Example 1 ]

Figure 5:
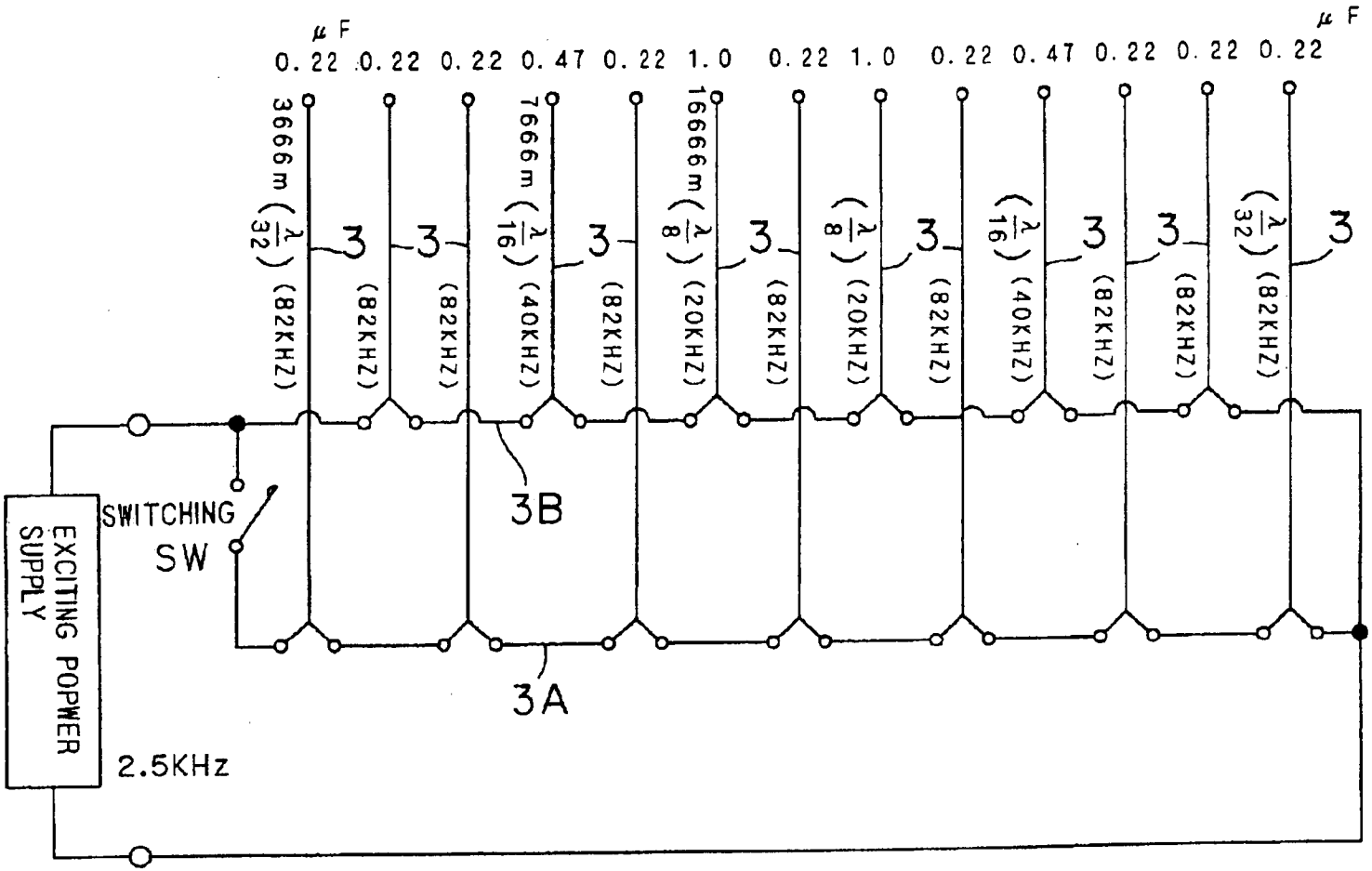
FIG. 5 is a schematic view showing an example of connection of a radiator of a radiating apparatus of the present invention.

FIG. 5 is a schematic wiring view showing one example of the radiating apparatus based on the theory of the invention. In this case, an excitation power source of 2.5 KHz is used, seven coaxial radiators 3 having capacitors of the same capacitance (0.22 $\mu$F) interposed between internal conductor and external conductor constitute a auxiliary body 3B, six coaxial radiators 3 having capacitors of different capacitances (0.22, 0.47, 1.0) interposed therebetween constitute a main body 3A, and coaxial radiators 3 of the main body 3A and the auxiliary body 3B are alternately arranged. Then, by switching circuits through which alternating current of 2.5 KHz passes, it is possible to select a case in which the coaxial radiators 3 of the auxiliary body 3B whose phantom lengths are set equal to each other are operated and specific strong wave motion is generated, and a case in which the coaxial radiators 3 of the main body 3A whose phantom lengths are set differently are operated to generate wave motion in which various wavelengths are superposed. As the capacity of the capacitor, a value which is ¼ n of the wavelength $\lambda$ of the alternating current frequency to which a phantom length of the radiator is supplied is selectively used. That is, the phantom length of the radiator is turned to a wavelength of the alternating current frequency to produce resonance.

[Example 2 ]

Figure 6:
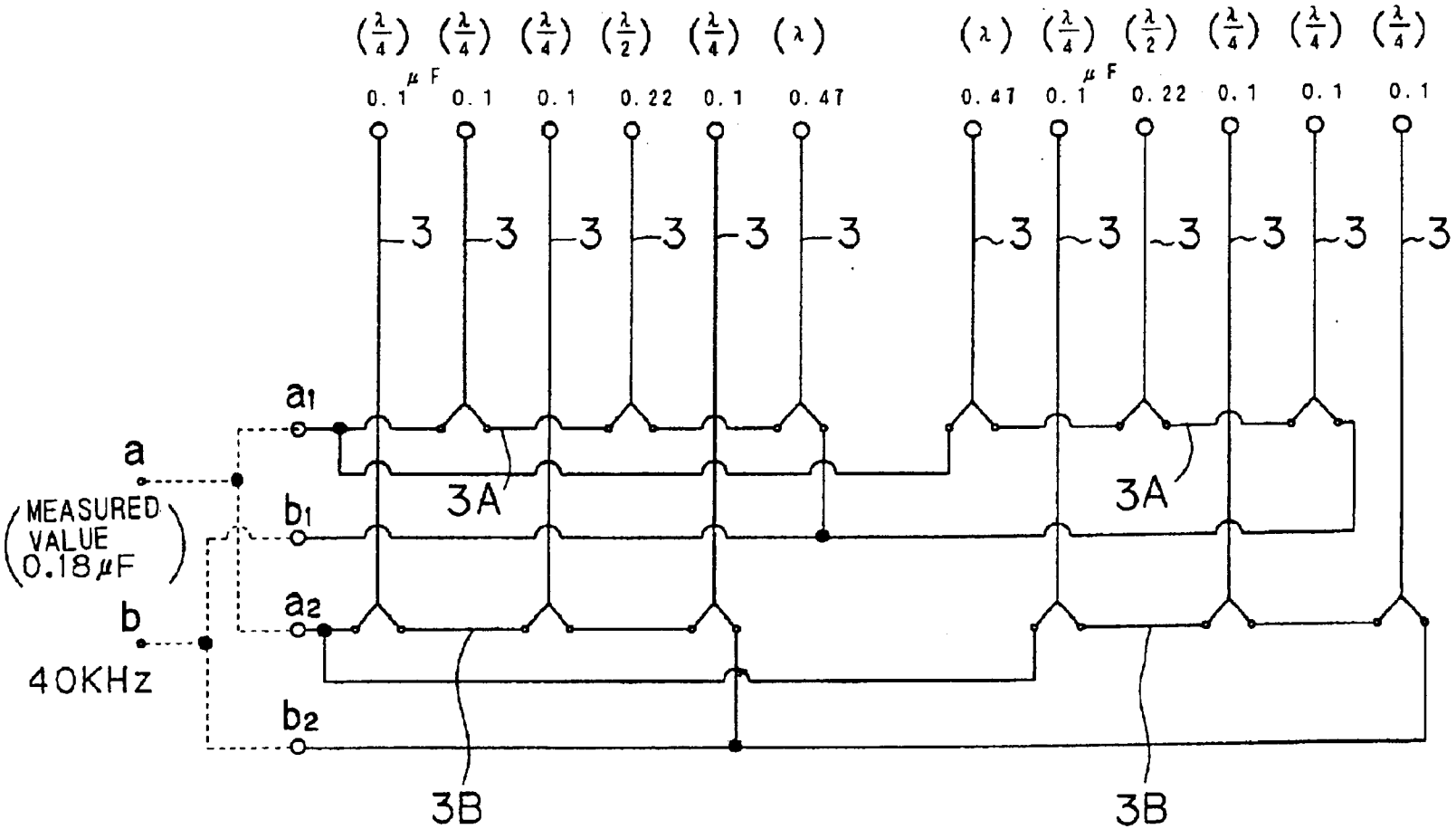
FIG. 6 is a schematic view showing another example of connection of the radiator of the radiating apparatus of the present invention.

FIG. 6 is a schematic wiring view showing another connecting example of the coaxial radiator of the present invention. As shown in FIG. 6, in this case, an exiting power source of 40 KHz is used, capacitors of 0.1 $\mu$F are used for the coaxial radiators 3 constituting the auxiliary body 3B, and capacitors of 0.1 $\mu$F, 0.22 $\mu$F and 0.47 $\mu$F are used for the coaxial radiators 3 constituting the main body 3A, three right coaxial radiators 3 and three left coaxial radiators 3 respectively constituting the main body 3A and the auxiliary body 3B are connected to each other in series, and the left and right coaxial radiators which are connected to each other in series are connected in parallel to each other. With this structure, it is possible to reduce the characteristics impedance to ¼ of the case of the serial connection, and it is possible to generate stronger radiation energy. In this case, the main body 3A and the auxiliary body 3B are excited at the same time so that both of them can operate at the same time. With this structure, ultrasounds having various wavelengths are generated, but they interfere with each other and the wave becomes composition wave having low frequency. Therefore, even if people is exposed to the radiation for a long time, this does not adversely affect the human body.

As described above, according to the radiating method and apparatus of wave motion of the invention, it is possible to give excessive electron and reducing properties directly to a subject without using any medium.

Although alternating current of 2.5 KHz and 40 KHz are used as the power source in the above description, the frequency of the power source used in the method and apparatus of the invention is not limited only if the frequency exceeds 100 Hz, and a range of 2.5 KHz to 40 KHz is recommended to obtain the effect.

What is claimed is:

1. A radiating method of wave motion for giving reducing properties using a plurality of coaxial radiators, wherein each of said coaxial radiators is provided at its center with an internal conductor, and an external conductor provided around said internal conductor through a dielectric, said coaxial radiators are arranged in a form of comb teeth-like shape, alternating current of high frequency corresponding to resonance frequency of said coaxial radiator is applied to said internal conductor and said external conductor such that directions of currents flowing through said internal conductor and external conductor are opposite, thereby oscillating ultrasound and generating variable electric field called static radio wave, and giving the reducing properties to a subject by an electron giving effect.

2. A radiating apparatus for giving reducing properties comprising a plurality of coaxial radiators arranged in a form of comb teeth-like shape and each of which is provided at its center with an internal conductor, and an external conductor provided around said internal conductor through a dielectric, and an oscillator for supplying high frequency alternating current to said coaxial radiator, wherein alternating current of high frequency corresponding to resonance frequency of said coaxial radiator is applied to said internal conductor and said external conductor such that directions of currents flowing through said internal conductor and external conductor are opposite, thereby oscillating ultrasound and generating variable electric field called static radio wave, and giving the reducing properties to a subject by an electron giving effect.

3. A radiating apparatus for giving reducing properties according to claim 2, wherein said coaxial radiators are curved in the same direction with equal curvature by fixing the coaxial radiators onto a curved reflection plate.

4. A radiating apparatus for giving reducing properties according to claim 3, wherein said coaxial radiator comprises a coaxial cable which is cut to a predetermined length.

5. A radiating apparatus for giving reducing properties claim 2, wherein said coaxial radiator comprises a coaxial cable which is cut to a predetermined length.

6. A radiating apparatus for giving reducing properties according to claim 5, wherein a casing of said coaxial cable is removed.

7. A radiating apparatus for giving reducing properties comprising a plurality of coaxial radiators arranged in a form of comb teeth-like shape and each of which is provided at its center with an internal conductor, and an external conductor provided around said internal conductor through a dielectric, and an oscillator for supplying high frequency alternating current to said coaxial radiator, wherein alternating current of high frequency corresponding to resonance frequency of said coaxial radiator is applied to said internal conductor and said external conductor such that directions of currents flowing through said internal conductor and external conductor are opposite, thereby oscillating ultrasound and generating variable electric field called static radio wave, and giving the reducing properties to a subject by an electron giving effect, and wherein each of said coaxial radiators is connected to said oscillator in series, a capacitor is provided between said internal conductor and said external conductor for turning wavelength to the applied alternating current wavelength.

8. A radiating apparatus for giving reducing properties according to claim 7, wherein said coaxial radiators are curved in the same direction with equal curvature by fixing the coaxial radiators onto a curved reflection plate.

9. A radiating apparatus for giving reducing properties claim 7, wherein said coaxial radiator comprises a coaxial cable which is cut to a predetermined length.

10. An electric field radiating apparatus comprising:

a reflection plate having a surface and a first end and second end;

a plurality of coaxial radiators each having an internal conductor and an external conductor with a dielectric placed between the internal and external conductors, each of said plurality of coaxial radiators extending from the first end to the second end along the surface of said reflection plate substantially parallel to each other; and an alternating current source coupled to said plurality of coaxial radiators, wherein said alternating current source is capable of providing a frequency corresponding to a resonance frequency of said plurality of coaxial radiators and such that a direction of current flow through the internal conductor is opposite to a direction of current flow through the external conductor.

11. An electric field radiating apparatus as in claim 10 wherein:

said reflection plate is curved.

12. An electric field radiating apparatus as in claim 11 wherein:

said reflection plate is convexly curved.

13. An electric field radiating apparatus as in claim 10 wherein:

said reflection plate comprises a material having no magnetic properties.

14. An electric field radiating apparatus as in claim 10 further comprising:

a capacitor coupled between the internal conductor and the external conductor for each of said plurality of coaxial radiators.

15. An electric field radiating apparatus as in claim 10 wherein:

said alternating current source provides an alternating current of a frequency between 100 Hz to 10 KHz.

16. A method of generating an electric field having a wave motion for providing reducing properties to a subject by an electron giving effect comprising the steps of:

mounting a plurality of coaxial radiators having an internal conductor and an external conductor with a dielectric placed between the internal and external conductors on a surface of a reflection plate so that each of said plurality of coaxial radiators extends from one end of the reflection plate to another end of the reflection plate along the surface and are spaced substantially parallel to each other;

applying an alternating current to the plurality of coaxial radiators sufficient to produce resonance of each of said plurality of coaxial radiators; and exposing the electric field to a subject, whereby the subject is exposed to the reducing properties.

17. A method of generating an electric field having a wave motion for providing reducing properties to a subject by an electron giving effect as in claim 16 further comprising the step of:

coupling a capacitor between each of the plurality of coaxial radiators.

* * * * *